US009382487B2

(12) United States Patent
Robinson et al.

(10) Patent No.: US 9,382,487 B2
(45) Date of Patent: Jul. 5, 2016

(54) SYSTEM AND METHOD FOR ACETYLENE RECOVERY

(71) Applicant: Carbide Industries, LLC, Louisville, KY (US)

(72) Inventors: Stewart W. Robinson, LaGrange, KY (US); Gregory M. Brasel, Louisville, KY (US); Craig Franklyn Dauphinee, Georgetown, IN (US); David Wilson Carter, Kuttawa, KY (US)

(73) Assignee: Carbide Industries, LLC, Louisville, KY (US)

( * ) Notice: Subject to any disclaimer, the term of this patent is extended or adjusted under 35 U.S.C. 154(b) by 329 days.

(21) Appl. No.: 14/210,639

(22) Filed: Mar. 14, 2014

(65) Prior Publication Data

US 2014/0275682 A1 Sep. 18, 2014

Related U.S. Application Data

(60) Provisional application No. 61/782,538, filed on Mar. 14, 2013.

(51) Int. Cl.
*C10H 15/06* (2006.01)
*C10H 21/00* (2006.01)

(52) U.S. Cl.
CPC ..... *C10H 15/06* (2013.01); *C10H 21/00* (2013.01)

(58) Field of Classification Search
CPC ..... C10H 15/00
See application file for complete search history.

(56) References Cited

U.S. PATENT DOCUMENTS 1,918,479 A * 7/1933 Milne ..... C10H 15/12 222/226
2,106,970 A * 2/1938 De Motte ..... C10H 15/06 48/38
2,233,109 A * 2/1941 Ness ..... C10H 1/00 48/38
2,293,160 A * 8/1942 Miller ..... C10H 21/00 105/248
2,415,328 A * 2/1947 Andersen ..... C10H 13/00 222/64
2,535,227 A * 12/1950 Ott ..... C10H 13/00 48/38
3,090,685 A * 5/1963 Pechtold ..... C10H 15/12 48/216
3,485,605 A * 12/1969 Bolintineanu ..... C10H 15/02 48/1
4,451,268 A * 5/1984 Lerch ..... C10H 3/00 422/618
5,955,040 A * 9/1999 Bunger ..... B01J 7/02 422/622

* cited by examiner

*Primary Examiner* — Matthew Merkling

(74) *Attorney, Agent, or Firm* — Woodard, Emhardt, Moriarty McNett & Henry LLP

(57) ABSTRACT

A method for generating acetylene from calcium carbide and recovering acetylene that would normally be lost during the process. The method includes putting calcium carbide into the purge bin of an acetylene generator; purging the purge bin with purge gas; transferring the calcium carbide to a hot aqueous bath in an acetylene generation chamber to generate acetylene; allowing a portion of the acetylene to move back into the purge bin where it mixes with the purge gas; passing the acetylene and purge gases through cold absorption water and allowing the absorption water to absorb some of the acetylene gas; transferring the absorption water back to the aqueous bath and allowing at least some of the acetylene to be released from the water as the temperature increases; recovering released acetylene; and using the aqueous bath to hydrolyze a subsequent batch of calcium carbide.

6 Claims, 10 Drawing Sheets

(Pre-Generation Purge Step)

(Acetylene Generation Step)

(Prior Art Post-Generation Purge Step)

(Post-generation Purge Step With Bubbler)

(Filling and Pre-Generation Purge Steps)

SYSTEM AND METHOD FOR ACETYLENE RECOVERY

REFERENCE TO RELATED APPLICATIONS

This application claims the benefit of U.S. Provisional Patent Application Ser. No. 61/782,538, filed Mar. 14, 2013, which is hereby incorporated herein by reference.

FIELD OF THE INVENTION

The present invention relates generally to a system and method for generating acetylene from calcium carbide, and more particularly to a system and method for recovering acetylene gas that would otherwise be lost during the commercial production of acetylene.

BACKGROUND TO THE INVENTION

It is known to generate acetylene from calcium carbide by the hydrolysis of the calcium carbide at elevated temperatures. Care must be taken to avoid introducing free oxygen into the hydrolysis reaction, so commercial acetylene generators use an inert gas, such as nitrogen, to purge the calcium carbide mixture of air before introducing the calcium carbide to the reaction vessel. After the calcium carbide mixture is purged of air in a purge hopper, the calcium carbide and nitrogen are transferred to a generator where they are mixed with water at an elevated temperature to generate acetylene. The transfer of calcium carbide and nitrogen to the reaction vessel results in the simultaneous transfer of some acetylene gas back into the purge hopper. In prior art acetylene generation methods, this acetylene is vented to the atmosphere during a post-transfer purge step to prepare the purge bin for a subsequent batch of calcium carbide.

A need currently exists for a system and method for recovering at least some of the acetylene that would otherwise be lost to the atmosphere during the post-generation purge. The present invention addresses that need.

SUMMARY OF THE INVENTION

Briefly describing one aspect of the present invention, there is provided a method for generating acetylene from calcium carbide and recovering acetylene that would normally be lost during the process. The method comprises providing acetylene gas generation equipment including a batch hopper, a purge hopper, a feed hopper, an acetylene generator, and an acetylene recovery chiller. Solid calcium carbide is provided to the batch hopper, and air filling in around the solid material causes the batch hopper to contain calcium carbide and air. The batch hopper may be purged with a purge gas in a quantity sufficient to purge the batch hopper of air and to cause said batch hopper to contain calcium carbide and purge gas, but to be substantially free of oxygen. The solid calcium carbide and purge gas are transported to the purge hopper to provide a purge hopper containing a mixture comprising calcium carbide and purge gas. The purge hopper is purged with a purge gas to provide a purge hopper containing a mixture comprising calcium carbide and the purge gas. The solid calcium carbide and purge gas are transported to a feed hopper to provide a feed hopper containing a mixture comprising calcium carbide and purge gas. The solid calcium carbide and purge gas are transported from the feed hopper to the acetylene generator, which includes an aqueous bath for generating acetylene gas by the hydrolysis of calcium carbide. Acetylene gas is generated, and some of the generated acetylene gas moves from the acetylene generator into the feed hopper and the purge hopper, where that acetylene gas mixes with the purge gas to form a combined gas. On purging this combined gas from the purge hopper, the combined gas is passed through a chilled absorption liquid to absorb therein at least some of the acetylene gas from the combined gas without substantially absorbing the purge gas. At least some of the absorption water with acetylene absorbed therein is transferred to the aqueous bath of acetylene generation chamber. The aqueous bath comprising absorption water with acetylene absorbed therein is thereafter used to hydrolyze a subsequent batch of calcium carbide. The method reduces the amount of VOC vented to the atmosphere, and increases the amount of acetylene available for recovery.

DESCRIPTION OF PREFERRED EMBODIMENTS

Figure 1:
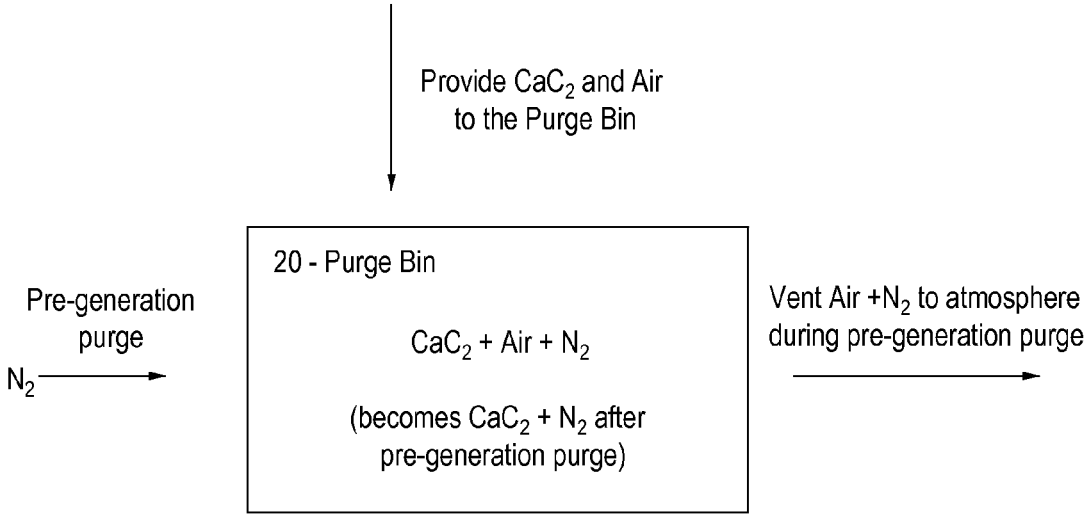
FIG. 1 is a flow chart of a pre-generation purge step that may be used in one aspect of the present invention, according to one preferred embodiment.

For the purposes of promoting an understanding of the principles of the invention, reference will now be made to certain preferred embodiments and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

As indicated above, one aspect of the present invention relates to a method for generating acetylene from calcium carbide and recovering acetylene that would normally be lost during the process. In this aspect of the invention, bulk solid calcium carbide is put into a batch hopper for an acetylene generation plant. It is understood that the portion of granular carbide introduced into the batch hopper bin will typically include air, which contains oxygen. The air introduced with the solid carbide into the batch hopper is then purged with a purge gas until substantially all of the oxygen is removed from the purge bin. The solid calcium carbide is then transferred to a purge hopper where the resident gas is purged and vented to an acetylene recovery chiller as more fully described below. The calcium carbide is then transferred to a feed hopper before being introduced into a hot aqueous bath in an acetylene generation chamber. Acetylene is generated in the acetylene generation chamber by the hydrolysis of the calcium carbide. The bulk of the acetylene is then recovered by standard methods.

The process is then repeated with a new batch of calcium carbide. The new batch of solid calcium carbide is put into the purge bin of the acetylene generation plant, and the purge bin is purged with a purge gas to remove substantially all of the resident gas from the purge bin. The solid calcium carbide is then transferred to a feed hopper before being introduced to the hot aqueous bath in the acetylene generation chamber. However, when these subsequent charges of solid calcium carbide are transferred into the acetylene generation chamber, a portion of the acetylene gas in the chamber typically moves back into the purge bin where it mixes with the purge gas.

In the prior art, that acetylene would simply be vented to the atmosphere from the purge hopper and lost. According to the present invention though, the acetylene and purge gas mixture is passed from the purge hopper into a cold absorption fluid (which may be water) so that the absorption fluid can absorb some of the acetylene gas. Most preferably, the acetylene and purge gas mixture is passed through cold absorption water by bubbling the mixture through the water. The absorption fluid is selected to be a fluid in which acetylene is more soluble than nitrogen, thus causing the acetylene to be preferentially absorbed into the fluid, leaving the nitrogen substantially not absorbed.

It is to be appreciated that while this description refers to the acetylene (or the nitrogen) as being "absorbed" into the fluid, the gas(es) may more accurately be said to be dissolved into the fluid. For the purposes of this disclosure therefore, the terms may be used interchangeably, with the system and methods of the present invention causing the acetylene to be preferentially absorbed/dissolved into the absorption fluid, while leaving the nitrogen substantially unabsorbed/undissolved.

It is also to be appreciated that while this description refers to the acetylene (or the nitrogen) as being absorbed into an "absorption fluid" or into "water", those terms are generally used interchangeably to indicate an absorption fluid that may be water. The use of the term "water" is not to be construed to exclude other absorption fluids, and the term "absorption fluid" is not to be construed to exclude water.

The absorption water and dissolved acetylene may then be transferred back to the aqueous bath. The return of absorption water and acetylene into the aqueous bath of the acetylene generation chamber causes less acetylene to be absorbed into the aqueous bath during the acetylene generation process, thus making more acetylene available for recovery. The loss of acetylene into the generator water during the generation process is minimized since the generator water is now richer in acetylene. The acetylene that is provided by the acetylene recovery process offsets acetylene that would otherwise be lost to the generator water, thus allowing that acetylene to be recovered from the generator.

The released acetylene is thereafter recovered by physical separation of the acetylene gas from the aqueous bath, as occurs with newly generated acetylene. In particular, the lighter acetylene gas is piped away from the top while the heavier aqueous bath remains below.

The acetylene generation bath containing recycled acetylene absorption water (and some dissolved acetylene) may subsequently be used to hydrolyze another batch of calcium carbide. The recovery may occur after the aqueous bath has been used to hydrolyze a subsequent batch of calcium carbide, or it may occur before the aqueous bath has been used to hydrolyze a subsequent batch of calcium carbide.

In some embodiments of the inventive system and method the solid calcium carbide is provided to a top, fill bin of a multi-bin carbide feed system of an acetylene generation system before being transferred to the purge bin. As when the calcium carbide is initially provided directly to a purge bin, air typically fills the space around the calcium carbide in the fill bin.

The calcium carbide and air may then be transferred to a middle, purge bin of the carbide feed system. Vibratory or screw feeders may be used to assist the transfer.

Once the calcium carbide has been provided to the purge bin, a purge gas is used to flush acetylene from the purge bin. The purge gas may be substantially any gas that doesn't contain oxygen or another species that would be detrimental to the acetylene generation process or the equipment or personnel, with nitrogen being most preferred due to its effective performance and low cost.

The carbide/nitrogen mixture may then be fed to the acetylene generation chamber. As with the transfer of calcium carbide to the purge bin, vibratory or screw feeders may be used to assist with the transfer. When the acetylene generation chamber has previously been used to generate acetylene, and when some of that acetylene remains in the acetylene generation chamber, the filling action displaces acetylene from the acetylene generation chamber and that acetylene gas enters the purge bin where it mixes with nitrogen. At this point the now "empty" purge bin contains an acetylene/$N_2$ atmosphere.

The acetylene/purge gas mixture must be purged before refilling with more calcium carbide from the fill bin. The method of the present invention accomplishes that purge step with reduced losses of acetylene. In particular, the acetylene and purge gas mixture is passed through cold absorption water that absorbs some of the acetylene gas but leaves the purge gas substantially not absorbed. The absorption water and dissolved acetylene may then be transferred back to the aqueous bath where the temperature of the generator water increases the temperature of the absorption water. The acetylene in the absorption water offsets acetylene that would otherwise be absorbed into the generator water, thus allowing generated acetylene to be recovered with less loss to the generator water. The acetylene generation bath containing recycled acetylene absorption water (and some dissolved acetylene) may subsequently be used to hydrolyze another batch of calcium carbide.

A series of valves is preferably used to control the flow of materials in the system. In particular, the purge bin preferably includes a top (fill) valve and a bottom (feed) valve. In the embodiments in which a fill bin is used, the fill bin also may include a top (fill) valve and a bottom (feed) valve.

As to the function of the valves, and particularly as to the function of the valves in the purge bin, the top (fill) valve is open and the bottom (feed) valve is closed while solid calcium carbide is being loaded into the bin. Then, the top valve is closed while the air in the purge bin is purged and replaced with the purge gas. Once the purge bin is purged, the bottom valve is opened to allow the solid calcium carbide and attendant purge gas to move to the acetylene generation chamber.

When a fill bin is used, the top (fill) valve of the purge bin is opened (the bottom valve was closed before purging) and carbide is allowed to drop from the top (fill) bin filling the purge bin. This displaces $N_2$ from the purge bin into the top (fill) bin. Once the top (fill) bin is empty, the purge bin top (fill) valve is closed and the purge bin is now ready for the next bottom (feed) bin fill cycle. The top bin is now empty and ready for filling from the carbide storage silo (which is also $N_2$ purged). This is done using a similar cycle to that described for the purge bin except that now there is no acetylene.

Referring now to the Figures, FIG. 1 shows the pre-generation purge step of one aspect of the present invention, according to one preferred embodiment. Similar pre-generation purge steps may also be used in prior art acetylene generation methods. Calcium carbide is put into the purge bin of an acetylene generator, and the air in the purge bin is removed by purging the bin with a purge gas until substantially all of the oxygen is removed from the purge bin. The air and excess purge gas, which is preferably nitrogen, may be vented to the atmosphere.

Figure 2:
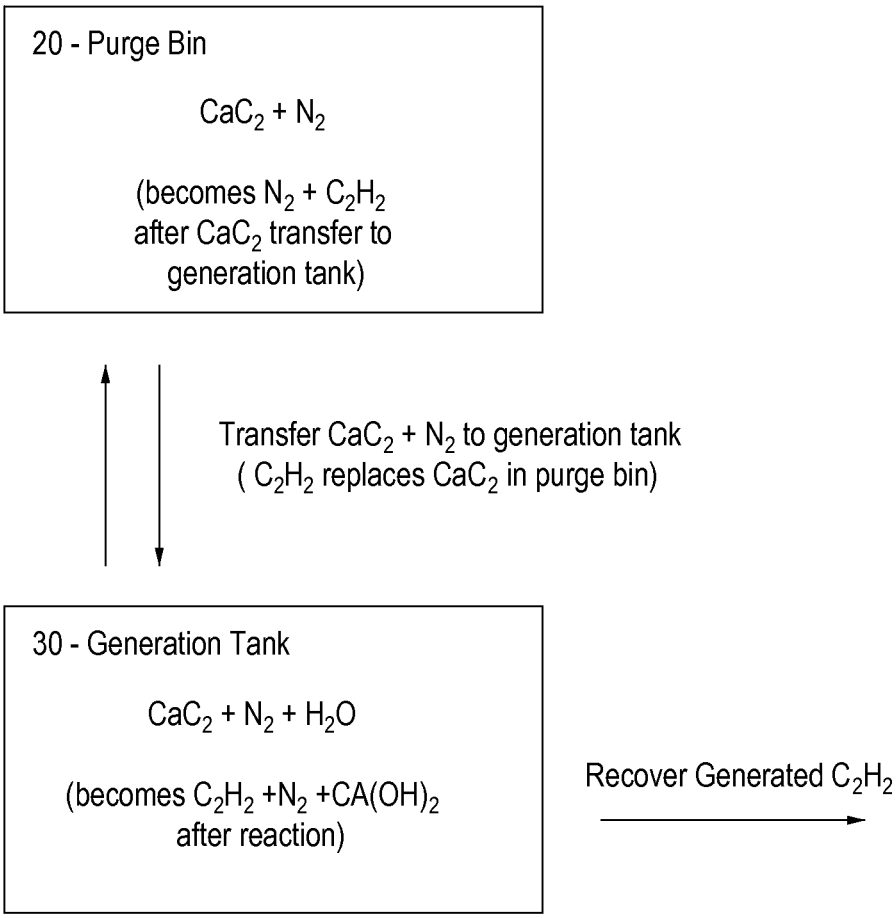
FIG. 2 is a flow chart of an acetylene generation step that may be used in one aspect of the present invention, according to one preferred embodiment.

FIG. 2 shows the acetylene generation step of one aspect of the present invention, according to one preferred embodiment. Similar acetylene generation steps may also be used in prior art acetylene generation methods. Calcium carbide is transferred from the purge bin to an aqueous bath in an acetylene generation chamber (optionally through a feed hopper). The aqueous bath is preferably maintained at an elevated temperature. When the calcium carbide is transferred into the acetylene generation chamber a portion of the acetylene gas in the chamber moves back into the purge bin where it mixes with the purge gas. Acetylene is generated in the bath by the hydrolysis of the calcium carbide.

Figure 3:
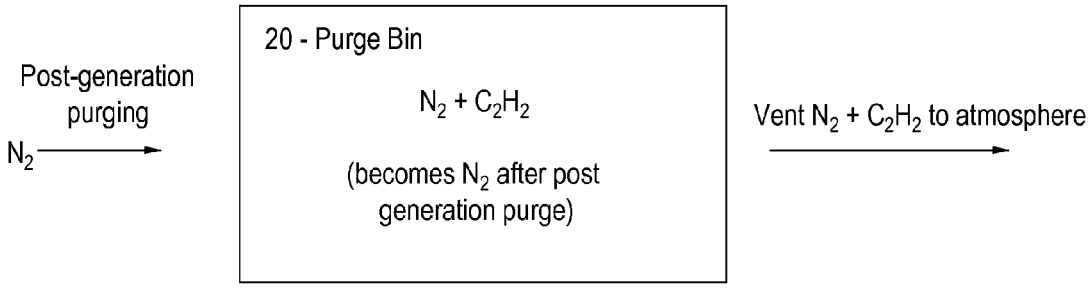
Fig. 3 (PRIOR ART)
FIG. 3 is a flow chart of the post-generation purge step of prior art acetylene generation methods.

FIG. 3 shows the post-generation purge step that was typically used by prior art acetylene generation methods. In the prior art, the acetylene that escaped to the purge bin during the transfer of calcium carbide to the acetylene generation chamber would simply be vented to the atmosphere.

Figure 4:
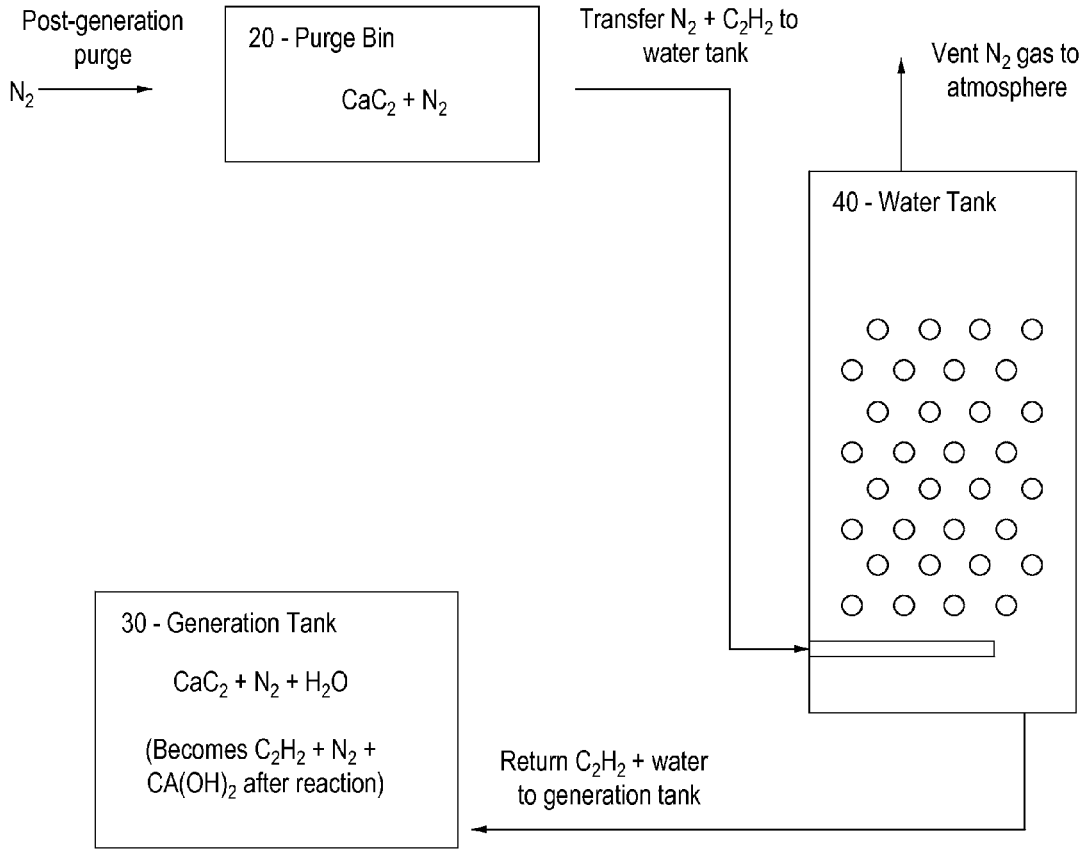
FIG. 4 is a flow chart of the post-generation purge step of one aspect of the present invention, according to one preferred embodiment.

FIG. 4 shows the post-generation purge step of one aspect of the present invention, according to one preferred embodiment. In the present invention, the acetylene that escapes to the purge bin during the transfer of calcium carbide to the acetylene generation chamber is allowed to mix with purge gas to form a gas mixture. That mixture of acetylene and purge gas is passed through cold absorption water so that the absorption water can absorb some of the acetylene gas. The cold absorption water is preferably maintained at a temperature of about 0° C. to about 20° C. At those temperatures, the cold absorption water is believed to absorb (dissolve) about 1.7 g of acetylene per kg of water.

The absorption water and dissolved acetylene is then transferred back to the aqueous bath where the temperature of the absorption water increases by contact with the hot acetylene generation bath. Since the hot acetylene generation bath will typically hold less than about 1 g of acetylene per kg of water, this releases at least some of the acetylene that was dissolved in the absorption water. The released acetylene provides additional acetylene to the acetylene generation bath, and thus provides an acetylene generation bath that will thereafter hold less acetylene that it would hold if additional acetylene were not recycled back into the bath. This reduces the amount of generated acetylene that will be absorbed into the acetylene generation bath, thus making more of the generated acetylene available for recovery.

In the most preferred embodiments, the acetylene generation bath containing recycled acetylene absorption water is thereafter used to hydrolyze a subsequent batch of calcium carbide. The recovery of acetylene may occur before or after the subsequent acetylene generation.

Figure 5:
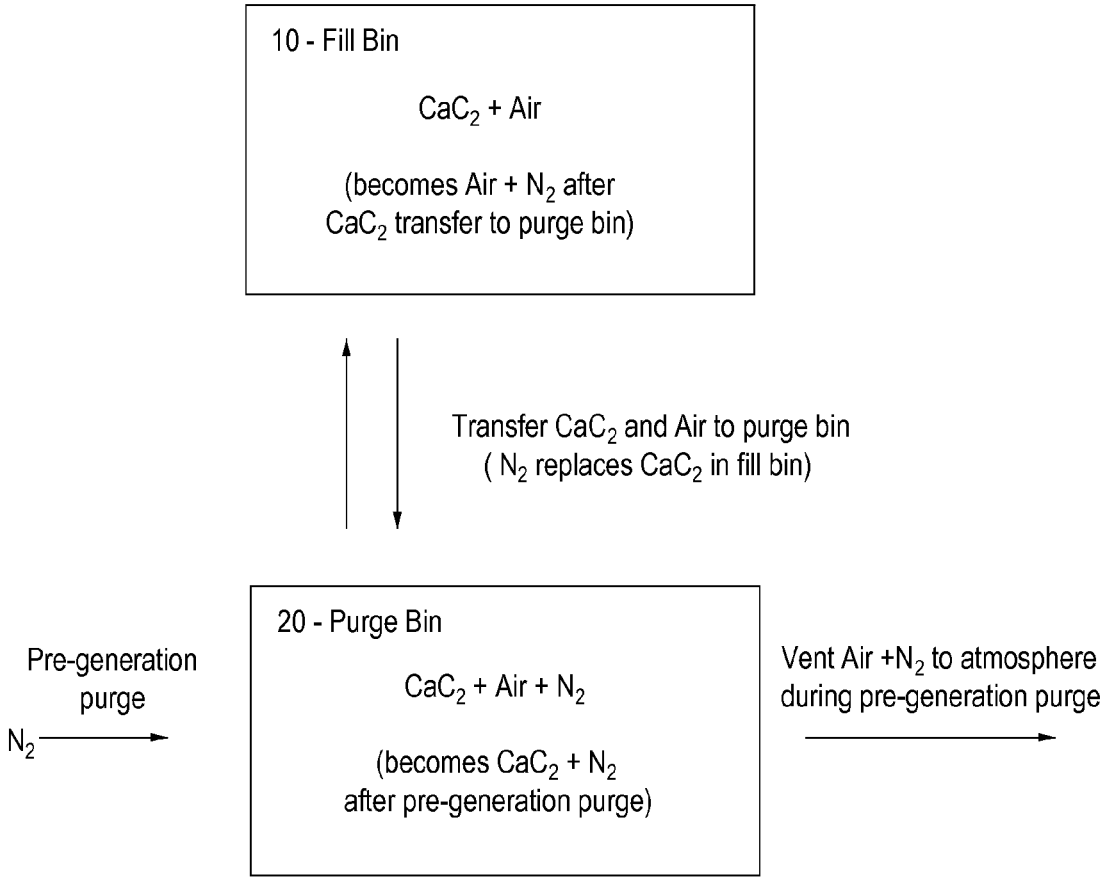
FIG. 5 is a flow chart of filling and pre-generation purge steps that may be used in one aspect of the present invention, according to another preferred embodiment.

FIG. 5 shows the filling and pre-generation purge steps of another embodiment of the present invention. Calcium carbide is provided to a top, fill bin of a multi-bin carbide feed system of an acetylene generation system. Air naturally fills the space around the calcium carbide in the fill bin. The calcium carbide and air are then transferred to a middle (purge) bin of the carbide feed system, and nitrogen is used to flush acetylene from the purge bin.

The carbide/nitrogen mixture is then fed to the acetylene generation chamber using either vibratory or screw feeders. The filling action displaces acetylene from the bottom bin which mixes with the nitrogen from the purge bin so that the now empty purge bin contains an acetylene/$N_2$ atmosphere. This must be purged before refilling with carbide from the top bin. The method of the present invention accomplishes that purge step with reduced losses of acetylene.

Once purged, the top (fill) valve of the purge bin is opened (the bottom valve was closed before purging) and carbide is allowed to drop from the top (fill) bin filling the purge bin. This displaces $N_2$ from the purge bin into the top (fill) bin. Once the top (fill) bin is empty, the purge bin top (fill) valve is closed and the purge bin is now ready for the next bottom (feed) bin fill cycle. The top bin is now empty and ready for filling from the carbide silo (which is also $N_2$ purged). This is done using a similar cycle to that described for the purge bin except that now there is no acetylene.

Figure 6:
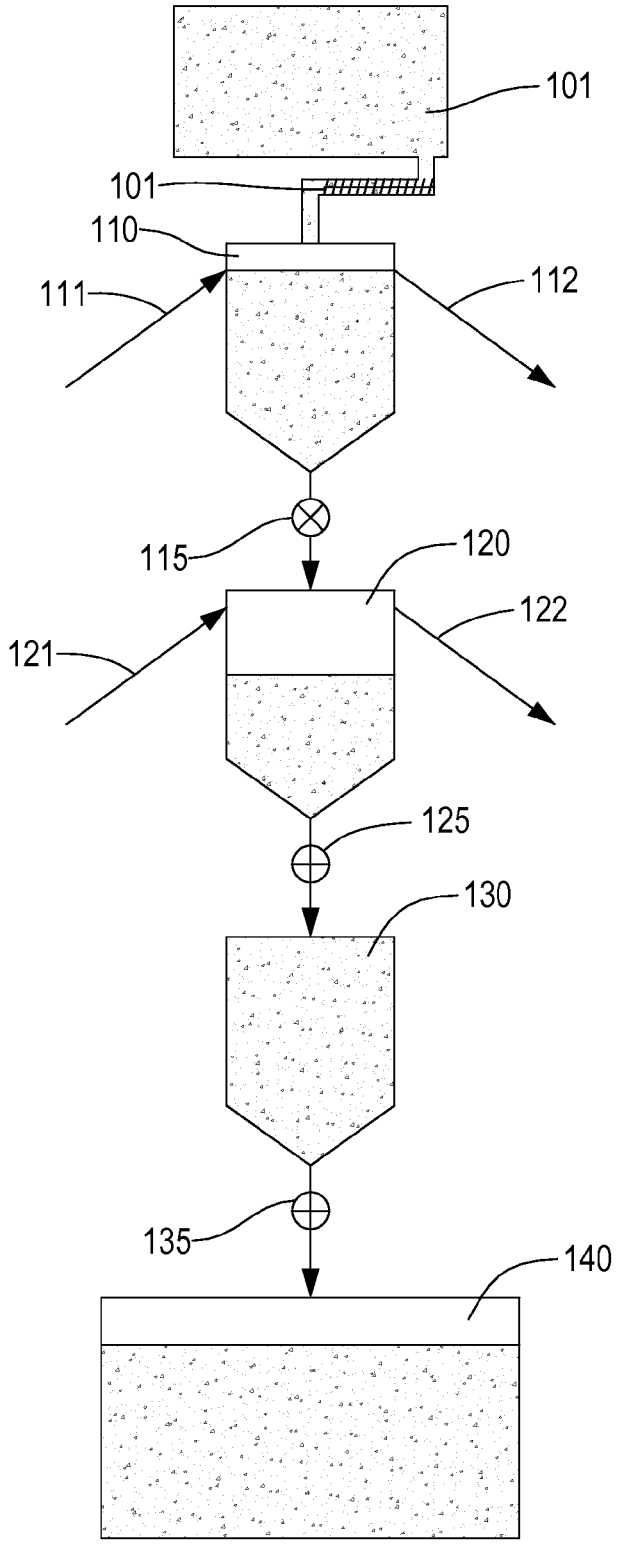
FIG. 6 shows preferred components of the acetylene generation portion of the present invention during a typical run cycle under normal operating conditions.

FIG. 6 shows preferred components of the acetylene generation portion of the present invention during a typical run cycle under normal operating conditions. Since the process is preferably run continuously, it is arbitrary to identify a "start" point of the process, but for this illustrative example we begin with solid carbide material being stored in silo 101. The silo is preferably kept under a slow nitrogen purge, but the purge is not effective to remove all air from the solid carbide material. Accordingly, the material present in silo 101 typically comprises carbide, nitrogen and air.

Screw feed 105 delivers the carbide, nitrogen and air material to batch hopper 110. Batch hopper 110 is under a continuous nitrogen purge through dry nitrogen purge inlet 111. Batch hopper 110 vents to the atmosphere through vent 112. When batch hopper 110 contains a full batch of nitrogen-purged carbide, screw feed 105 is turned off and batch hopper discharge valve 115 is in its 'closed' position.

As this point the purge hopper 120 preferably contains a partial batch of carbide and purge hopper discharge valve 125 is open. Purge hopper 120 is under a continuous nitrogen purge through dry nitrogen purge inlet 121, and vents to the chiller/water tank 40 (see FIG. 4) through vent 122.

Feed hopper 130 preferably contains a full batch of carbide and is choked with carbide from the purge hopper through open discharge valve 125. Discharge valve 135 of feed hopper 130 is also open, allowing carbide to be drawn out and discharged into the generator.

Figure 7:
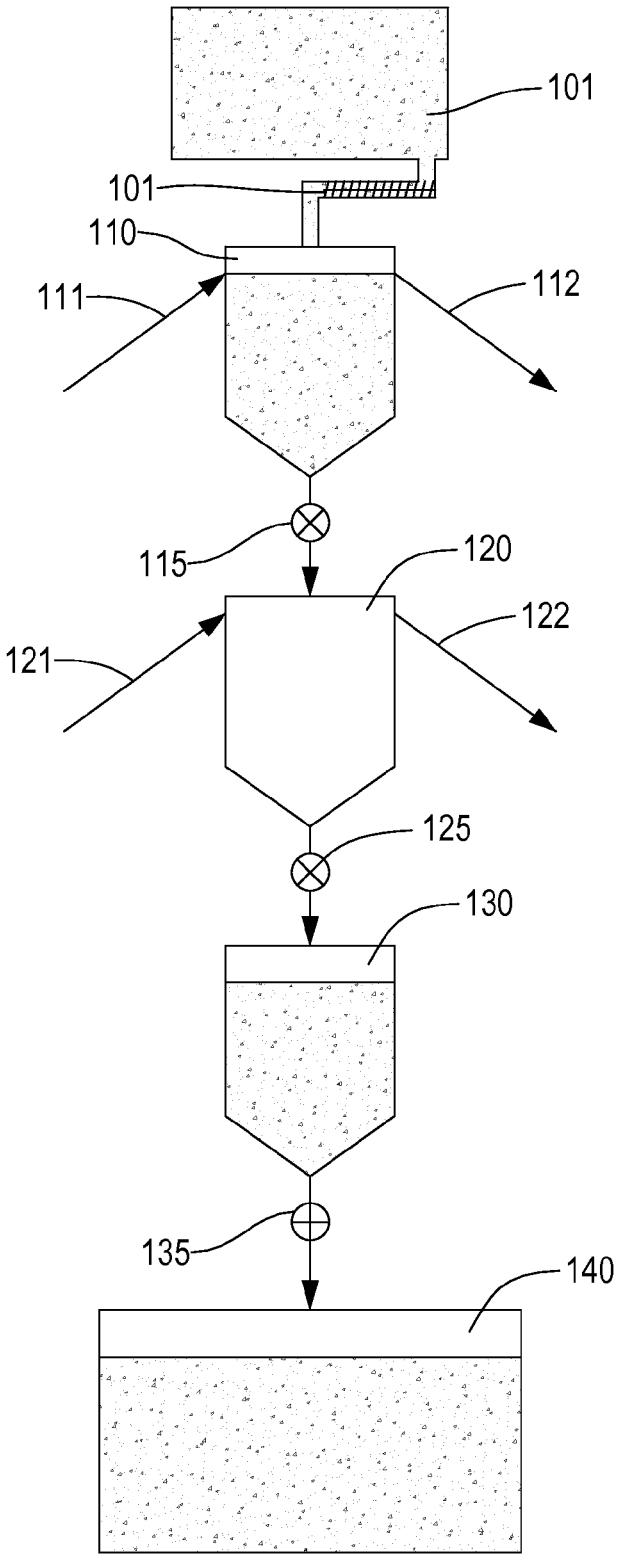
FIG. 7 shows the discharge portion of a purge hopper discharge and refilling cycle.

FIG. 7 shows the discharge portion of a purge hopper discharge and refilling cycle. As carbide is removed from the feed/purge hopper combination, the carbide level eventually falls to the level of a lower level detector in the purge hopper. This starts a timer, and after an appropriate time (e.g., after 60 seconds) the purge hopper is deemed to be empty and ready for refilling. Discharge valve 125 of purge hopper 120 then closes. At this stage, the empty purge hopper contains an atmosphere of dry nitrogen, from both the continuous nitrogen purge and nitrogen swept from the carbide interstices by its movement.

The batch and purge bins continue to be kept under a nitrogen purge. It is to be appreciated that during the removal of carbide from the purge and feed hoppers the continuous nitrogen purge allows for make-up of the displaced carbide volume thus minimizing the tendency for acetylene feedback from the generator.

Figure 8:
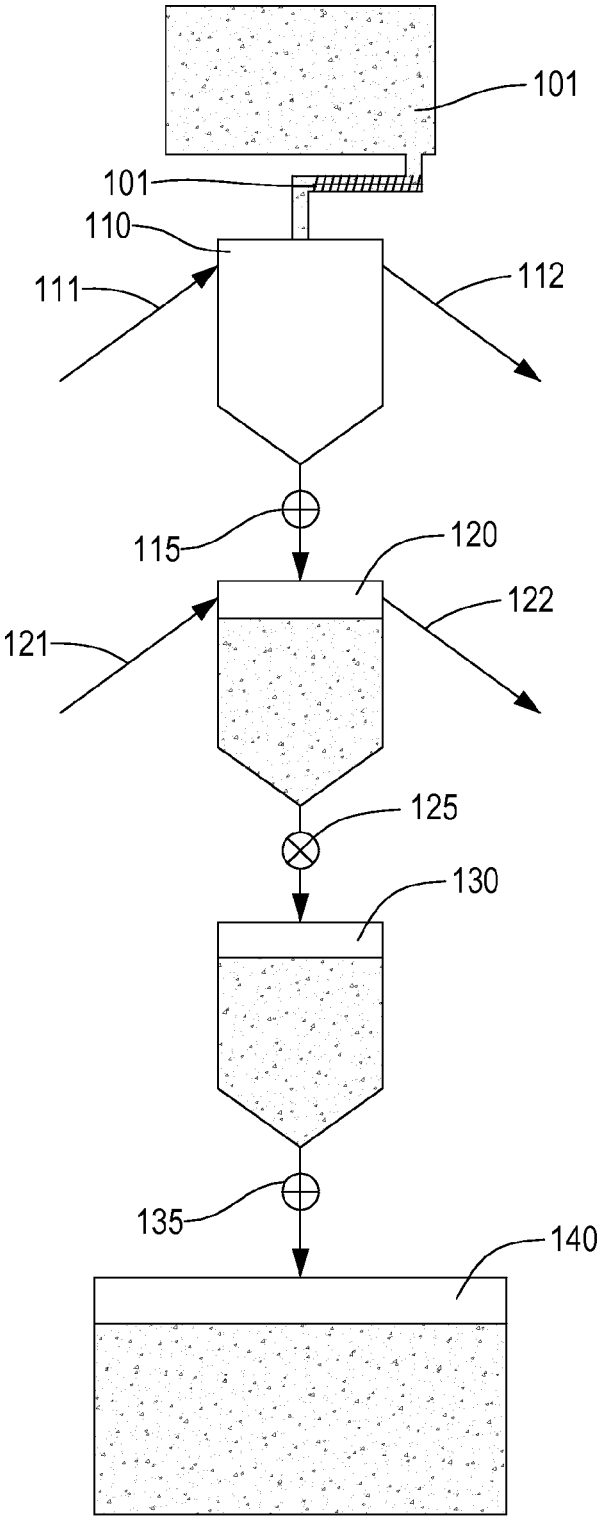
FIG. 8 shows the refilling portion of the purge hopper discharge and refilling cycle illustrated in FIG. 7.

FIG. 8 shows the refilling portion of the purge hopper discharge and refilling cycle referenced in FIG. 7. As indicated above, batch hopper 110 and purge hopper 120 are still under continuous purge, and the carbide in batch hopper 110 is substantially free of entrained air since carbide silo 101 has been kept under a slow continuous nitrogen purge.

The refilling portion of the purge hopper discharge and refilling cycle begins as batch hopper discharge valve 115 opens and nitrogen purged carbide drops from batch hopper 110 into purge hopper 120. As with the discharge portion of the purge hopper discharge and refilling cycle, when the carbide level in batch hopper 110 reaches a lower batch hopper level detector it starts a timer. After an appropriate time (e.g., after 60 seconds) the batch hopper is deemed to be empty and ready for refilling. Batch hopper discharge valve 115 now closes and its refilling cycle initiates.

Figure 9:
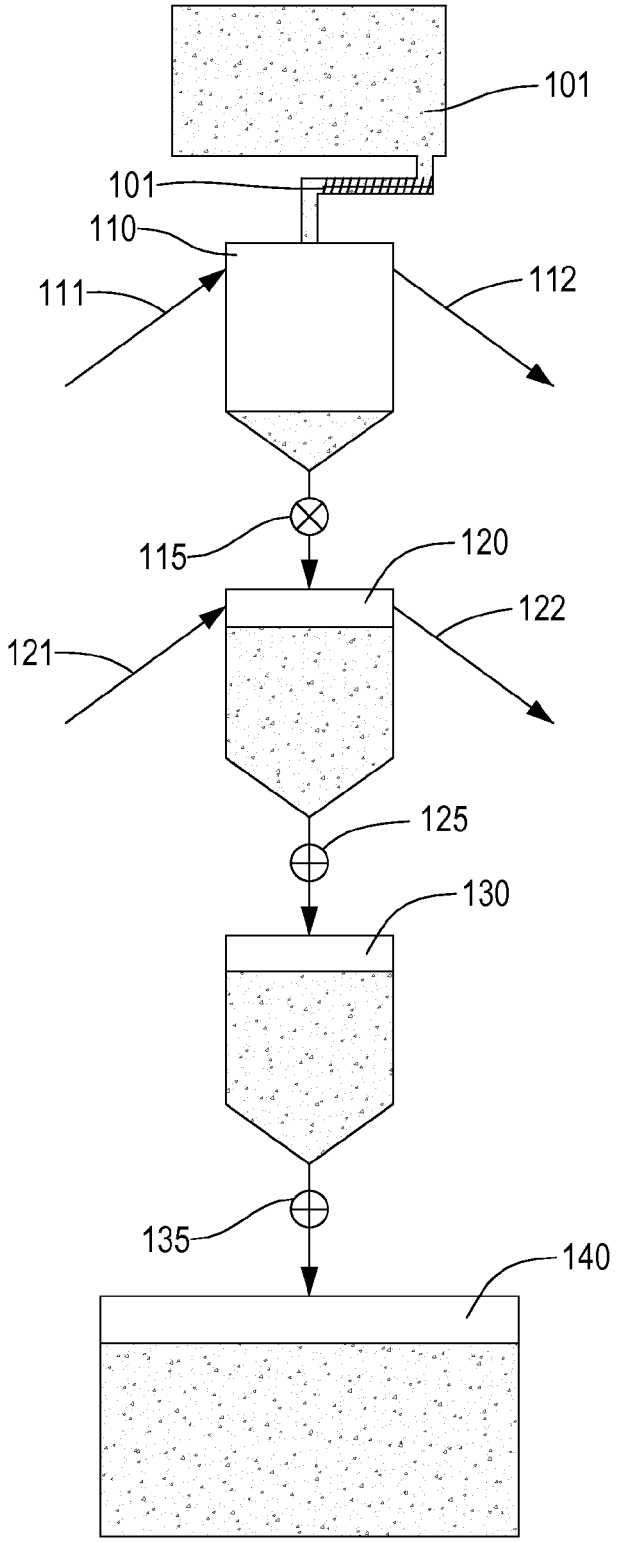
FIG. 9 shows a feed hopper refilling cycle.

FIG. 9 shows a feed hopper refilling cycle. At this stage purge hopper 120 contains a full batch of nitrogen-purged carbide and the batch hopper is starting to refill, with batch hopper discharge valve 115 and purge hopper discharge valve 125 are both in their closed position. Feed hopper 130 still contains the major fraction of its own batch of carbide.

Purge hopper discharge valve 125 now opens and carbide again chokes back into feed hopper 130. Batch hopper 110 simultaneously begins a refill cycle so that the batch hopper and the feed hopper refilling cycles take place at the same time.

Figure 10:
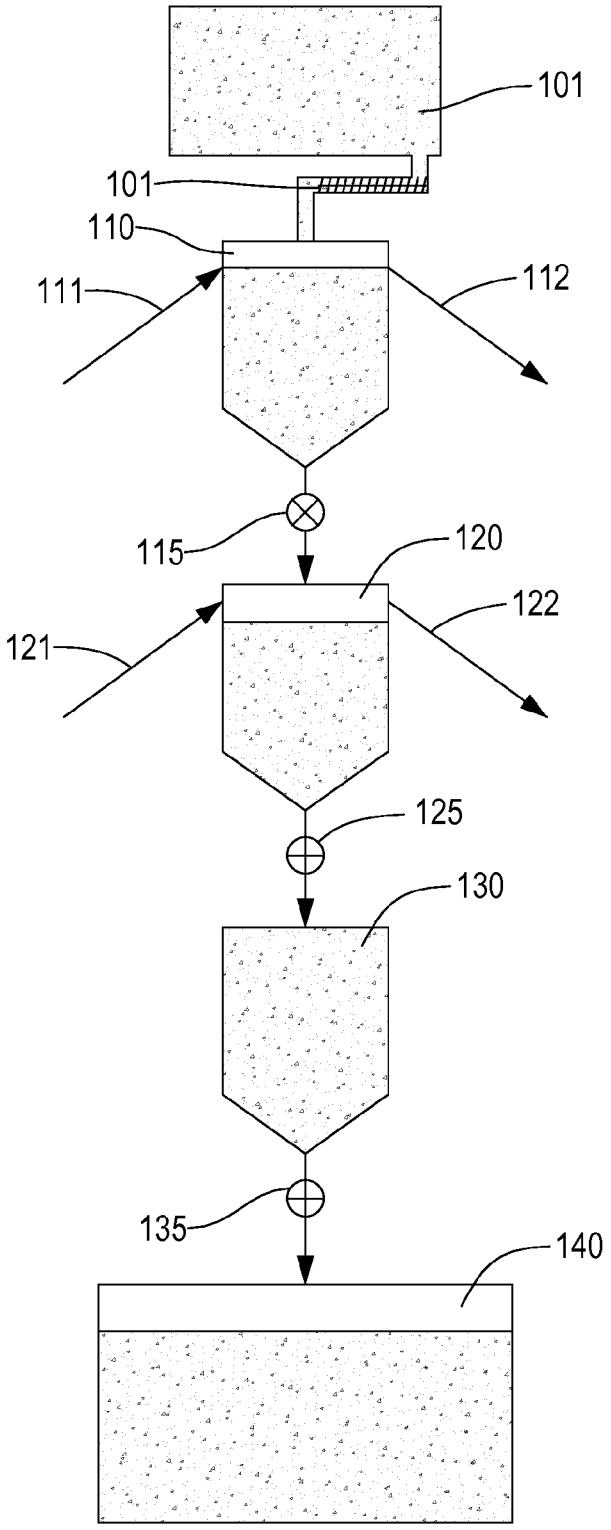
FIG. 10 shows a batch hopper refilling cycle.

FIG. 10 shows a batch hopper refilling cycle. The batch hopper is refilled with carbide from the storage silo using a screw feeder. When the carbide level in the batch hopper reaches the level of its hopper level detector, this signals that the hopper contains a full batch of carbide and the screw feeder stops.

The batch hopper and purge hopper are still under a continuous nitrogen purge. The generator "RUN" cycle may then repeat.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. Moreover, the invention encompasses embodiments both comprising and consisting of any or all of elements described with reference to the illustrative embodiments.

The invention claimed is:

1. A method for generating acetylene and recovering acetylene gas, comprising the acts of:

a) providing acetylene gas generation equipment including a batch hopper, a purge hopper, a feed hopper, an acetylene generator, and an acetylene recovery chiller;

b) providing solid calcium carbide and air to said batch hopper to provide a batch hopper containing calcium carbide and air;

c) purging said batch hopper with a purge gas in a quantity sufficient to purge said batch hopper of air and to cause said batch hopper to contain calcium carbide and purge gas, but to be substantially free of air;

d) transporting solid calcium carbide and said purge gas to said purge hopper to provide a purge hopper containing a mixture comprising calcium carbide and purge gas, and optionally including acetylene that has filtered back into the purge hopper from an acetylene generator;

e) purging said purge hopper with a purge gas to provide a purge hopper containing a mixture comprising calcium carbide and said purge gas;

f) transporting solid calcium carbide and said purge gas to said feed hopper to provide a feed hopper containing a mixture comprising calcium carbide and purge gas;

g) providing an aqueous bath in said acetylene generator;

h) transporting solid calcium carbide and said purge gas to said aqueous bath, thereby causing acetylene gas to be generated by the hydrolysis of calcium carbide;

i) allowing a portion of said acetylene gas to move from said acetylene generator into said feed hopper and into said purge hopper, wherein said portion of acetylene gas mixes with said purge gas to form a combined gas;

j) passing said combined gas through a chilled absorption liquid to absorb therein at least some of the acetylene gas from said combined gas without substantially absorbing said purge gas;

k) transferring at least some of said absorption liquid with acetylene absorbed therein to the aqueous bath of acetylene generation chamber; and l) using said aqueous bath comprising absorption liquid with acetylene absorbed therein to hydrolyze a subsequent batch of calcium carbide.

2. A method according to claim 1 wherein said acetylene gas generator further includes a fill bin, and wherein said method further includes the acts of:

a) providing solid calcium carbide to said fill bin to provide a fill bin containing calcium carbide and air; and b) transferring calcium carbide and air from said fill bin to said purge bin.

3. The method of claim 1 wherein the purge gas comprises nitrogen gas.

4. The method of claim 1 wherein said passing said combined gas through absorption water is done by bubbling said combined gas through water.

5. The method of claim 1 wherein there is a gate/valve between said purge bin and said acetylene generation chamber, and wherein said transferring said solid calcium carbide to the aqueous bath of said acetylene generation chamber, and said allowing a portion of said acetylene gas to move from said acetylene generation chamber into said purge bin, is done by batch process dumping solid calcium carbide from said purge bin into said generation chamber while having said gate/valve open, thereby displacing acetylene gas from said acetylene generation chamber into said purge bin by the adding of volume of calcium carbide into said acetylene generation chamber, and thereafter closing said gate/valve leaving said combined gas in said purge bin.

6. The method of claim 1 and further comprising the act of maintaining said absorption water at a cool temperature between about 0° C. degrees and 20° C. degrees to promote absorbing acetylene while reducing absorption of the purge gas.

* * * * *